United States Patent [19]

Pogson et al.

[11] Patent Number: 4,463,798

[45] Date of Patent: Aug. 7, 1984

[54] ELECTROSTATICALLY PUMPED HEAT PIPE AND METHOD

[75] Inventors: John T. Pogson, San Jose, Calif.; Roger L. Shannon, Federal Way, Wash.; Robert H. Hamasaki, Seattle, Wash.; James L. Franklin, Auburn, Wash.; Dale F. Watkins, Sumner, Wash.; Ted J. Kramer, Auburn, Wash.

[73] Assignee: The Boeing Company, Seattle, Wash.

[21] Appl. No.: 223,205

[22] Filed: Jan. 7, 1981

[51] Int. Cl.[3] ..... F28D 15/00

[52] U.S. Cl. ..... 165/1; 165/104.23; 165/46; 165/104.26; 417/48

[58] Field of Search ..... 165/104.23, 104.28, 165/104.26, 104.25, 46; 417/48

[56] References Cited

U.S. PATENT DOCUMENTS

| | | | |
|---|---|---|---|
| 3,135,207 | 6/1964 | Brown et al. | 417/48 |
| 3,212,442 | 10/1965 | Jorgenson et al. | 417/48 |
| 3,265,970 | 8/1966 | Stuetzer | 324/92 |
| 3,267,859 | 8/1966 | Jutila | 417/48 |
| 3,267,860 | 8/1966 | Brown | 417/48 |
| 3,398,685 | 8/1968 | Stuetzer | 417/48 |
| 3,417,267 | 12/1968 | Marks | 310/6 |
| 3,441,752 | 4/1969 | Grover et al. | 310/4 |
| 3,682,239 | 8/1972 | Abu-Romia | 165/1 |
| 4,003,427 | 1/1977 | Leinoff et al. | 165/104.26 |
| 4,220,195 | 9/1980 | Borgoyn et al. | 165/104.23 |
| 4,252,185 | 2/1981 | Kosson | 165/104.25 |

FOREIGN PATENT DOCUMENTS

| | | | |
|---|---|---|---|
| 641262 | 1/1979 | U.S.S.R. | 165/104.23 |

*Primary Examiner*—Albert W. Davis, Jr.

*Attorney, Agent, or Firm*—Delbert J. Barnard; Eugene O. Heberer

[57] ABSTRACT

The heat pipe has a condensing area at one end and an evaporating area at the other end. An ion drag pump is within the condensing area to receive dielectric refrigerant condensate in its inlet. There is a liquid carrying tube having one end connected to the pump outlet and having its other end terminating adjacent the evaporating area to discharge refrigerant condensate therein. The evaporating area has heat receiving flow paths into which the condensate is adapted to flow and be vaporized, there being a vapor flow path from the evaporating area through which the vaporized refrigerant returns to the condensing area.

The method includes cooling one end of the heat pipe to liquefy refrigerant therein to form a condensate, flowing the condensate into an ion drag pump and applying a sufficiently high voltage across a cathode and anode of the pump to produce ions in the refrigerant condensate, the ions then being accelerated toward the anode so as to create fluid motion and pumping action through the pump inlet. The condensate is thereby pumped through a closed-wall flow path to the other end of the heat pipe to which heat is applied to evaporate the refrigerant into a vapor. The vapor from the other end is then flowed to the one end of the pipe in which the condensate is formed by cooling.

23 Claims, 9 Drawing Figures

ELECTROSTATICALLY PUMPED HEAT PIPE AND METHOD

BACKGROUND OF THE INVENTION

In conventional heat pipes a refrigerant is cooled in a condenser so as to form a condensate. The condensate is transported to an evaporator at the other end of the pipe by capillary action in a wick, the wick generally extending from one end of the pipe, in the condenser to the other end of the pipe, in the evaporator. When the condensate moves into the evaporator, it is vaporized by the application of heat to the evaporator wall. The vaporized refrigerant removes heat from the evaporator wall and stores it as latent heat of vaporization. The vapor moves toward the condenser because of a slight pressure difference between the evaporator and the condenser. In the condenser, the vapor is cooled and the condensate is formed. As it is condensed the refrigerant gives up its latent heat of vaporization to the condenser wall, a cooling device being adapted to carry the latent heat away. Thus, in the process the refrigerant acquires latent heat of vaporization in the evaporator and loses it in the condenser. Heat pipes have thus been used as a means of removing heat from one area and disposing of it in another.

The action of a conventional heat pipe stops if one of several heat pipe limits are reached. The most significant of these is the lack of adequate capillary pumping action to supply the evaporator with fluid. For wick materials such as screen or porous metals, this limit can be expressed in equation form as:

$2\sigma/r_{min} = \Delta\rho_{static} + \Delta\rho_{flow}$, where $\sigma$ = surface tension, $r_{min}$ = minimum meniscus radius allowable, $\Delta\rho_{static}$ = hydrostatic pressure due to the evaporator elevation being greater than the condenser elevation, and $\Delta\rho_{flow}$ = flow pressure drop.

For typical heat pipe working fluids such as ammonia, where the wick is 400 mesh wire cloth, the maximum value of $2\sigma/r_{min}$ is 18.6 cm.

The first of the two pressure drops, $\Delta\rho_{static}$, exists only in gravitation or acceleration environments and does not, therefore, affect spacecraft heat pipes in flight. It does occur, however, in ground testing and therefore must be considered even in spacecraft heat pipes.

The second pressure drop term, $\Delta\rho_{flow}$ affects all heat pipes and arises from viscous drag on the moving fluid. In many designs, this restriction has been decreased by employing arteries consisting of tubes formed by fine mesh wire cloth, sealed at the ends, and in liquid communication with both the evaporator and condenser. When primed, or filled with fluid, the arteries take on the capillary pumping capability of the pores of the artery wall, but have a much bigger flow channel cross section and therefore, less pressure drop, than a simple wick consisting of stacked layers of wire cloth. The arteries thus permit an increased flow of fluid and higher heat transport rates, with increased artery diameter required as the heat pipe is made longer. A limit exists, however, on the diameter, and therefore, the capicity of an artery. When testing in one g, this limit relates to the maximum diameter which can be primed because artery priming requires that the fluid "climb" or "rise" to the top of the artery.

The use of an artery, although permitting an increase in heat transfer rate, can also create another failure mode, namely, arterial vapor bubble entrapment. When this occurs, the artery deprimes because the radius of curvature, instead of being that associated with the screen pores, is now the radius of the artery. Bubble formation in arteries occurs as the result of vibration, shock or rapid temperature fluctuation.

In general the capillary pumping limit places operating constraints on heat pipe operation in that the vaporization rate in the evaporator cannot exceed the capillary pumping rate and the height of the evaporator above the condenser cannot exceed the capillary wicking height. Capillary action pumping also limits the heat flux that can be applied to the evaporator. Because vapor bubbles in the wicking materials can effect "dry out" and stop the capillary pumping action, the heat flux must be kept below that of the nucleate boiling regime. This is the "nucleate boiling limit".

Heat pipes with wicking materials in the vapor flow passages are also subject to the "entrainment limit" which arises at vapor flows high enough to entrain liquid droplets from the wick.

SUMMARY OF THE INVENTION

The present invention eliminates the problems of the prior art heat pipes with the employment of an ion drag pump and improved structural changes within the pipe. The ion drag pump is positioned within the condensing area of the pipe where it receives refrigerant condensate which it pumps to the evaporator. The pump is comprised of a pointed cathode in proximity with an anode having a passage therethrough. High voltage difference across the electrodes results in a high voltage gradient at the cathode. This gradient produces ions in a dielectric refrigerant, such as trichlorotrifluoroethane, and they are accelerated toward the anode. Momentum transfer between the ions and neutral fluid molecules gives rise to fluid motion so as to create a pumping action through the anode.

No wick is required in the condenser at one g level operation. The pump makes it possible to transport condensate for relatively long distances through a small diameter artery which can be comprised of a solid wall tube in contrast to porous prior arteries. Long distance pumping is possible because capillary forces do not dominate the liquid transport capability. Where the pressure drop, because of artery length or configuration, would be prohibitive with a single pump, pumps can be connected in series to achieve increased pumping pressure. They also can be connected in parallel to produce greater flow rates. Bubbles formed in arteries can be pushed to the evaporator and vented, and both pumping pressure and capillary action can be used to distribute the fluid within the evaporator.

In the present invention, a solid wall tube extends from the pump in the condenser to the evaporator in which the liquid is distributed in heat receiving flow paths adjacent the evaporator wall where an external heat source evaporates the condensate. In the evaporator the refrigerant acquires latent heat of vaporization and is pumped back to the condenser through an open annulus surrounding the central closed wall tube through which the condensate flows to the evaporator.

According to the invention, the relaxed requirements of artery materials permits flexible joints to be incorporated in the heat pipe by means of bellows sections, for example. This permits the heat pipe to thermally link a spacecraft, for example, with such devices as scan platforms or deployable appendages. Where flexible joints have been used in the prior art, flexing action placed severe limitations on the artery design and also introduced the possibility for screen tearing or crimping which adversely affected performance.

Accordingly, it is an object of the invention to provide an improved heat pipe in which limits on the heat pipe length are substantially eliminated, there being no significant friction loss or capillary pumping problems. The ion drag pumps can be placed in series to increase the pumping pressure and can be staged to overcome the effects of gravity and accelerational forces.

It is another object of the invention to retain the desirable features of the heat pipes in the prior art. The invention is comprised of a completely sealed pipe containing a small charge of a dielectric working fluid, a miniature ion drag pump, a central closed wall artery and an open annulus around the artery to return the vaporized fluid to the condenser.

It is still another object of the invention to provide a heat pipe in which the start up time is much more rapid than that of conventional units, relying on capillary transport of liquid.

A further object of the invention is to provide a heat pipe having a pump having no moving parts, requiring no lubrication, and which may be constructed primarily from light weight ceramic or plastic materials.

It is a still further object of the invention to provide a heat pipe which may be quickly shut off and act as a heat flow diode. When the pump power is turned off, heat transport ceases and in contrast to prior art units, the direction of heat flow will not reverse when the condenser section temperature exceeds that of the evaporation temperature.

Another object of the invention is to provide a heat pipe having a long life and the absence of vibration resulting from the lack of moving parts in the pump.

It is still another object of the invention to provide a heat pipe in which heat flux is much higher than that associated with prior art units where the pump can flood the evaporator.

Potential applications for this invention are: energy transport in spacecraft, especially future large-scale satellites; cooling of densely packaged avionics in missiles and aircraft; cooling of highflux loads such as in radars, power supplies, and power processing equipment; and isothermalization of spacecraft structure where dimensional stability is required.

It is a further object of the invention to provide the combination of a heat pipe and an ion drag pump which results in a heat transfer device with capabilities far in excess of those of a conventional heat pipe in many applications.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes.

DESCRIPTION OF THE PREFERRED EMBODIMENTS

Figures 1, 2, 3:
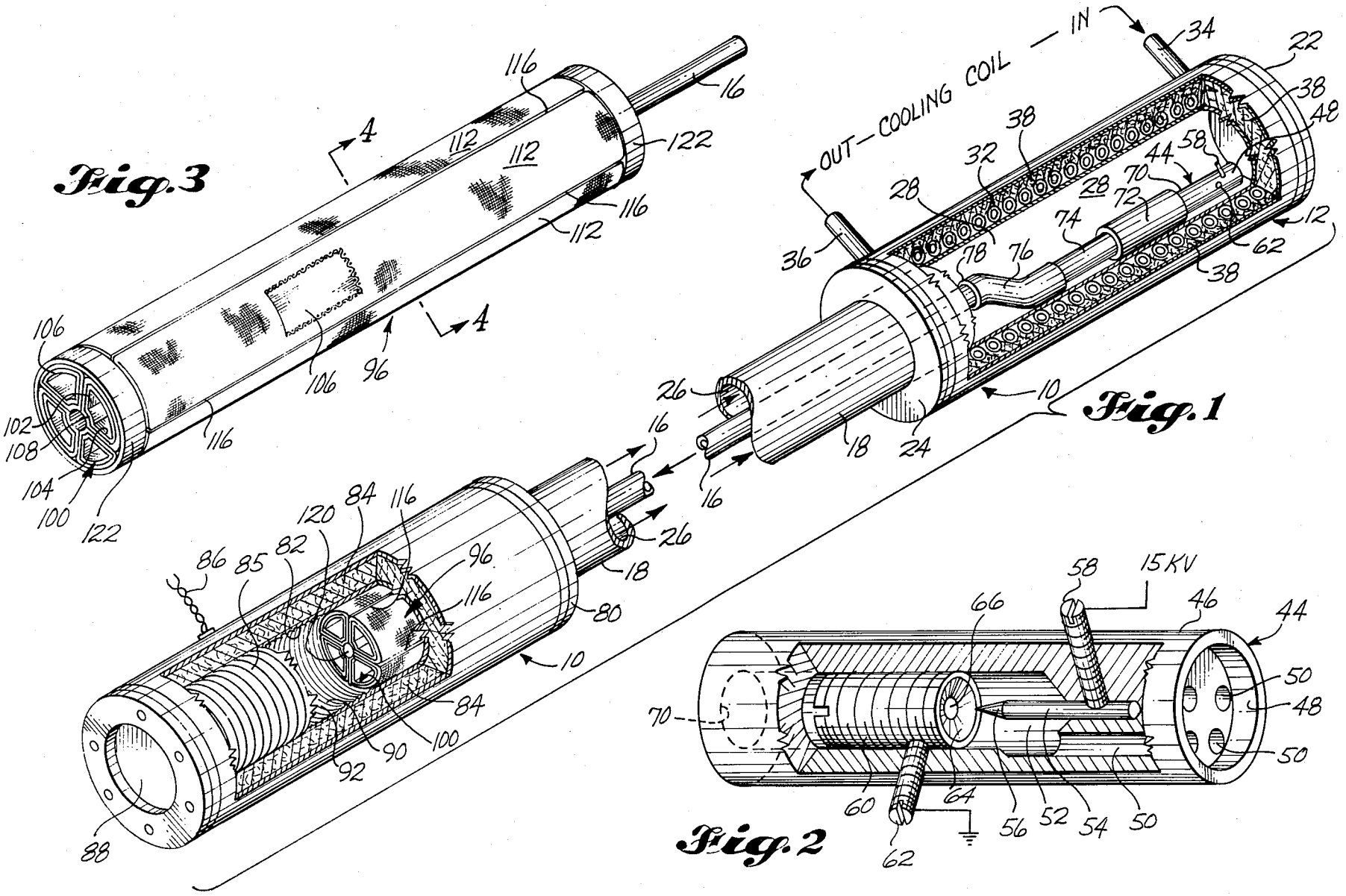
FIG. 1 is an interrupted perspective view, partially cutaway, of an electrostatically pumped heat pipe according to the invention.
FIG. 2 is a perspective cutaway view of an ion drag pump employed in the heat pipe shown in FIG. 1.
FIG. 3 is a perspective view of a wick, according to the invention, providing heat receiving flow paths for use in an evaporator in the heat pipe.

Referring again to the drawings, there is shown in FIG. 1 an electrostatically pumped heat pipe, generally designated as 10, having an enclosed condenser 12 at one end, and an evaporator 14 at the other end. The evaporator and the condenser are connected by an artery or a closed wall condensate flow tube 16 and a pipe 18, the tube being concentric in the pipe to form a vapor flow annulus 26.

The condenser 12 has a sealed cylindrical housing 20 closed at end 22 and the return vapor pipe 18 is sealingly secured in its other end 24. Inwardly the housing has a cylindrical condensing chamber 28, open to the pipe 18. Surrounding the condensing chamber 28, in heat transfer contact therewith is a cooling coil 32 having a coolant inlet 34 and an outlet 36. Outwardly of the cooling coil and at the ends is a layer of insulating material 38.

Adjacent the end 22 is an ion drag pump 44, shown in detail in FIG. 2. The drag pump has a nonconducting, generally cylindrical housing 46 and at end 48 has four condensate inlet passages 50 in communication with an electrode chamber 52. The rod cathode 54, having a conical end 56, is secured within the housing 46 by means of a set screw 58. A high voltage supply is connected to the set screw 58 and the cathode, the voltage being of the order of 15 KV or greater. An anode 60 of generally cylindrical configuration is secured within the chamber 52 by means of a set screw 62, connected to the housing 12 to ground the anode. Spaced from the cathode conical end 56 is a recessed end 64 of the anode from which extends a central passage 66. The passage 66 is the pump outlet, extending through the anode 60 and to an enlarged diameter outlet portion 70 at the left end of the pump. The pump 44 is positioned within the condensing chamber 28 so that the condensate readily flows into the inlets 50.

As shown in FIG. 1, there is a short plastic tube 72 connected to the end 70 of the pump. Inserted into the other end of the connecting tube 72 is a smaller diameter tube 74 which in turn is connected to a flexible tube 76 having a downstream end 78 and bent upwardly so as to be centrally positioned within the chamber 28 and with respect to the pipe 18.

The closed wall, liquid carrying tube 16 is sealingly secured into the end 78 and is supported centrally within the pipe 18.

The pipe 18 extends a short distance into end 80 of the evaporator 14 to which it is sealingly secured. The other end 88 of the evaporator is closed. A cylindrical metallic evaporating chamber 82 is centrally positioned within the evaporator 14 and is surrounded by insulating material 84, the chamber 82 being open to the pipe 18 and to the tube 16. Along the outer surface of the chamber 82 are nichrome ribbon heaters 85 which are the heat source for the evaporator, the heat source having a supply 86. The internal surface of the chamber 82 has a multiple of circular lands 90 and grooves 92, forming heat receiving flow paths.

Figure 4:
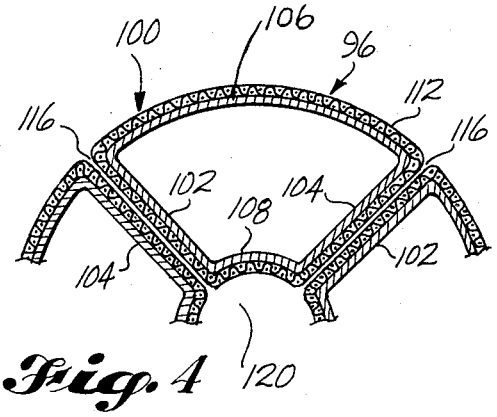
FIG. 4 is a fragmentary cross-sectional view taken along the line 4—4 in FIG. 3.

A wick or screened member, generally designated as 96, is shown in FIGS. 1, 3, and 4. The member 96 is comprised of four axially elongated metal frames, each generally designated as 100, and each having two radially directed sides 102 and 104 extending between an outwardly facing convex surface 106 and an inwardly facing concave surface 108. Each frame is wrapped in at least one layer of 400 mesh wire screen 112 so as to provide additional flow means along the frame surfaces. Between each of the adjacent sides 102 and 104 of respective frames and screen thereon is a heat receiving flow path 116, extending from the convex outer portions of the frame members 100 to the concave inner portions. The concave inner portions and screen form enlarged axially directed and centrally positioned flow path 120 connected to the closed wall pipe 16. The screen 112 and the frame members 100 are secured together by means of bands 122 at the ends of the member 96, FIG. 3.

By way of example, the heat pipe may be from 3 to 16 feet in length and the condensing and evaporating areas may be 1 foot in length and have inside diameters of 1 to 2 inches, the pipe or vapor flow path 18 having an outside diameter of about 1 to 2 inches. The closed wall tube 16 has an outside diameter of $\frac{1}{4}$ to $\frac{1}{2}$ inch and an inside diameter of 0.18 to 0.44 inch. The ion drag pump 44 is about 1.35 inches long and has an outside diameter of $\frac{3}{8}$ inch. The path 116 is 1/16 to $\frac{1}{8}$ inch..

The working fluid within the heat pipe 10 is a dielectric refrigerant, for example, trichlorotrifluoroethane (Freon 113). In general the refrigerant is at its saturation point and there must be a sufficient amount in the heat pipe system so that there is a continuous liquid flow into the ion drag pump 44 and a continuous vaporized gas flow from the evaporating area back to the condensing area.

In operation a heat pipe is positioned near a heat source so that excess heat can be transferred from that source by the evaporation of the refrigerant in the evaporator. The heat source is conveniently shown in the form of nichrome ribbon heaters 85 positioned on the exterior of the evaporating chamber. A typical heat source could have a temperature of between 80° F. to 180° F. to vaporize the working fluid. As the fluid vaporizes, it acquires its latent heat of vaporization and it flows primarily along the outer passages 116 into the annulus 26 of the pipe 18 and then directly into the condensing area 28. The coolant through the coil 32 causes the refrigerant to condense and flow into the inlets 50 of the pump 44. During condensing the fluid gives up its latent heat of vaporization which is carried away by the coolant. The coolant may be water or some liquid having a low freezing point, depending upon the environment; and the cooling temperature may be typically about 60° F.

The ion drag pump 44 is similar to that shown in U.S. Pat. No. 3,265,970. By the application of a high voltage difference across the cathode 54 and the anode 60, there results a high voltage gradient at the point 56 of the cathode which produces ions in the dielectric refrigerant that are accelerated toward the anode. As the ions move under the influence of the electric field existing between the two electrodes, they collide with molecules of the liquid and drag those molecules with them toward and through the anode at 66. That is, the momemtum transferred between the ions and the neutral fluid molecules causes fluid motion so as to create a pumping action. This pumping action causes the condensate to flow through the closed wall tube 16 into the passage 120, along the screens, their supporting frames, and then up the heat receiving flow passages in the screens along the sides 102 and 104 and is vaporized. The fluid continues to flow to the hottest part of the evaporator, that is, the lands and grooves 90 and 92, resepctively, along the frame surfaces 106. The vapor then moves radially inwardly into the passage 116 and axially toward the annulus 26, back to the condenser cavity 28, where the vapor is again condensed into liquid.

Figure 7:
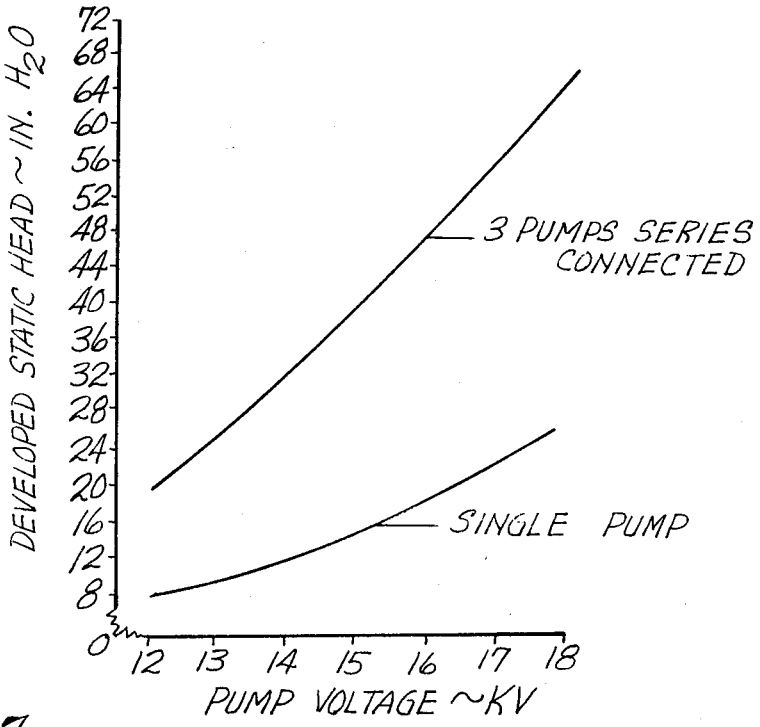
FIG. 7 is a graph showing static pumping head capabilities of single and three-stage ion drag pumps.

The application of the ion drag pump, according to the invention, in a heat pipe makes possible the transportation of a refrigerant over long distances because the prior art capillary forces in heat pipes no longer dominate the liquid transport capability. Furthermore, the substitution of solid wall tubes, as 16, in contrast to vented or open flow paths in the prior art makes the flow positive and bubbles formed can be pushed to evaporator and vented to purge the system.

Where pressure drop, due to artery length, in a tube as 16, or its configuration, would be prohibitive with a single pump, the units are connected in series to achieve increased pumping pressure. The results of a single pump and three pumps connected in a series are illustrated in FIG. 7. The three ion drag pumps, connected in series, were operated at maximum static head conditions, that is, near zero mass flow rate, to determine maximum pumping capability. As shown, the single pump has the capability of producing a head of 22 inches of water; whereas the three pumps in series produced static heads in the range of 66 to 68 inches of water, indicating no degradation performance due to staging of the pumps. The voltages used were as high as 18 KV.

Figure 8:
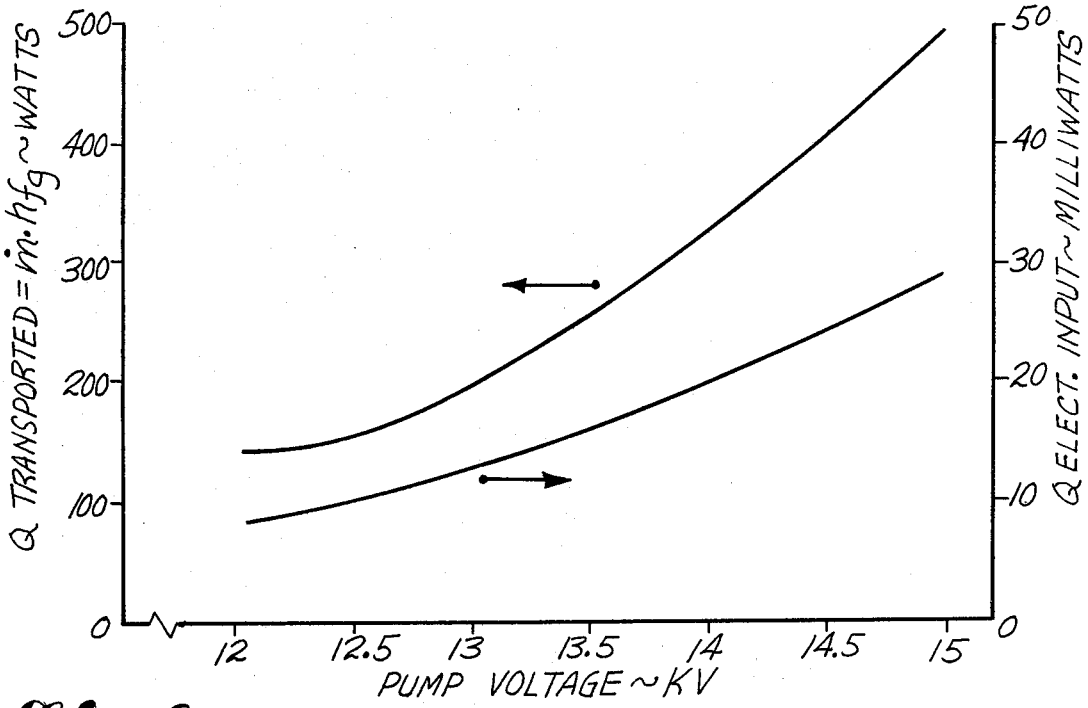
FIG. 8 is a graph illustrating the operating characteristics of an ion drag pump at constant pressure head.

The pump, as shown in FIGS. 1 and 2 and described above, was tested to determine the mass flow rate capabilities at a fixed static head. This test also indicated the required electrical input power over the pump's operating range. The tests were conducted with the pump receiving liquid from a reservoir and discharging it at the top of a vertical tube connected to the pump's output port. As shown in FIG. 8, the input voltages for this test sequence range from 12 to 15 KV. The results from this test are expressed as energy transport as $\dot{m} \cdot h_{fg}$, where $\dot{m}$ is the mass flow rate and $h_{fg}$ is the latent heat of evaporation. The product of the mass flow rate and the latent heat of evaporization at one g is shown in FIG. 8 where the pump performance is shown to increase with a rise in voltage in a power law fashion up to the maximum voltage. The power draw, as determined by direct ammeter and voltmeter readings, also rises with the voltage but at a somewhat reduced rate, as shown. At the peak efficiency point, the amount of thermal energy transport possible with Freon 113 as the working fluid is 17,000 times greater than the electrical power input to the pump.

Figure 9:
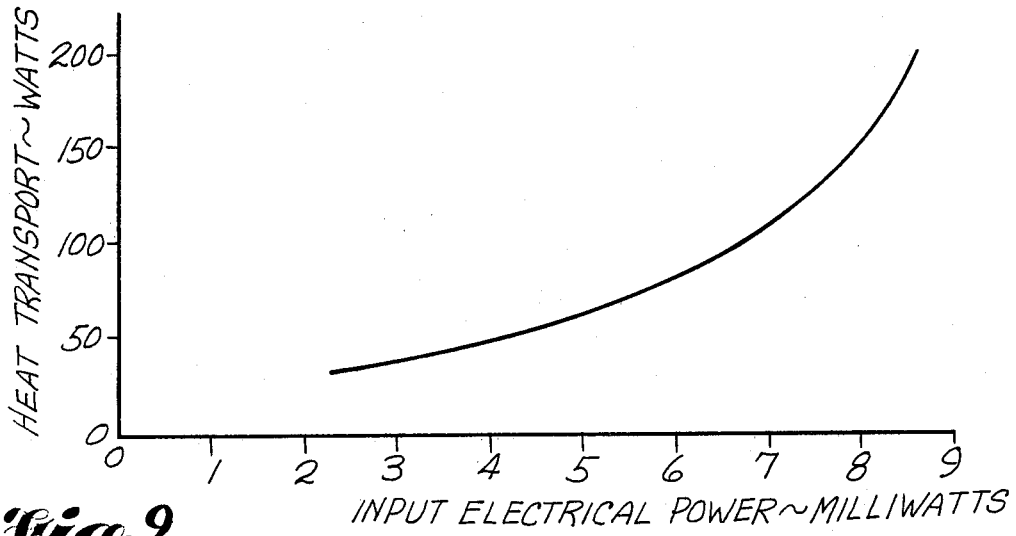
FIG. 9 is a graph illustrating the performance of an ion drag pump in a heat pipe at a one inch tilt.

In ion drag pump heat pipe tests, the evaporator was raised 1 inch above the condenser to eliminate the chance of liquid transport via puddle flow. The voltage was then continually increased from the threshold of pumping to the arcing limit. Energy was input to the thermally insulated evaporator by resistance heating of nichrome wire, as shown in FIG. 1. Condenser cooling was accomplished with a circulating fluid, constant temperature bath and temperature measurements were recorded with Type K thermocouples on the evaporator and condenser. Electrical power input to the pump was determined from direct ammeter and voltmeter readings. The test results are shown in FIG. 9 where it is indicated that the energy transport rate can be controlled by varying the pump power input. This "variable conductance" capability is an important feature that can be applied to cooling objects such as spacecraft batteries that generate varying amounts of heat and require a narrow range of temperature control. The performance data presented in FIG. 9 shows that a conductance turndown ratio of 8 to 1 was achieved with the test unit. Heat transport is seen to be a power law function of pump power input and follows the general shape of the constant-head pump characteristics presented in FIG. 8.

Figure 5:
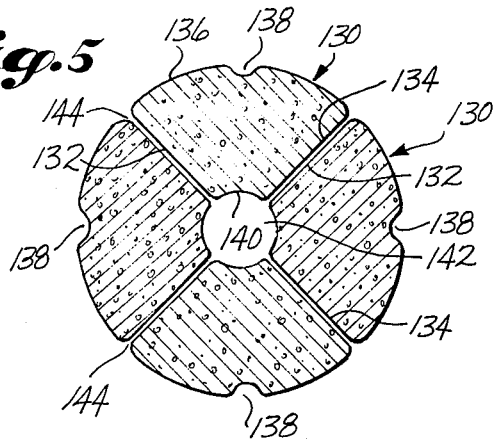
FIG. 5 is a cross-sectional view of another type of wick for use in an evaporator.

In FIG. 5 another form of heat receiving flow path structure or wick is shown as a substitution for structure 96 in FIG. 3. Here, there are four axially elongated sintered metal flow path forming members or frames 130 having the same general outer cross-sectional figuration as the frames 100 in FIGS. 3 and 4. Members 130 extend for the length of the evaporator and have four surfaces similar to the frames 100. There are two radially directed sides 132 and 134, outwardly facing convex surface 136, having an axially directed groove 138, and an inner concave surface 140. The four surfaces 140 form a central passage 142 for connection to the pipe 16. Outwardly of the passage 142 are radial heat receiving flow paths 144 spaced between the sides 132 and 134. The sintered metal has flow paths therethrough and also has a surface on which the liquid and gas are adapted to flow as they do on the screen in FIGS. 3 and 4. The vaporized refrigerant, for the most part flows, from the evaporator into the annulus 26 along the surfaces 136 and in the axially directed grooves 138.

Figure 6:
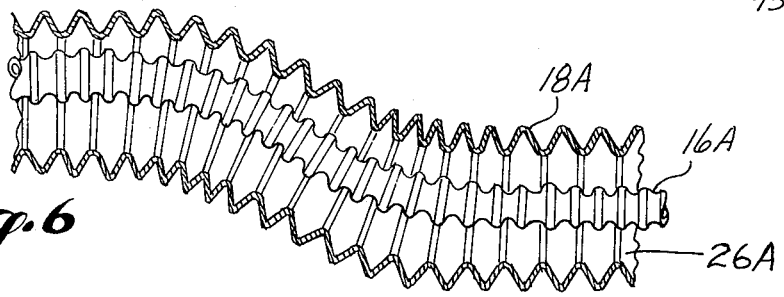
FIG. 6 is a fragmentary view of a portion of a heat pipe, according to the invention, formed of flexible pipe and tubing for bending.

According to the invention, where ion drag pumps are used in a heat pipe, the artery materials for closed wall tubes, as 16, and the pipes, as 18, may be made flexible as tube 16A and pipe 18A in the form of bellows, FIG. 6. Here, the heat pipe 18A forms an annulus 26A around the closed wall tube 16A, both the pipe and the tube being formed as an ogee curve. This permits the heat pipe to thermally link a spacecraft, for example, with such devices as scan platforms or deployable appendages. Flexible joints have been incorporated in prior art heat pipes but the flexing action placed severe limitations on the capillary flow open wall artery design and also introduced the possibility of screen tearing or crimping which adversely affected performance. As can be readily seen those problems do not exist with the bellows shown in FIG. 6 where condensate would be pumped through the tube 16A.

The invention and its attendant advantages will be understood from the foregoing description and it will be apparent that various changes may be made in the form, construction, and arrangements of the parts of the invention without departing from the spirit and scope thereof or sacrificing its material advantages, the arrangements hereinbefore described being merely by way of example. We do not wish to be restricted to the specific forms shown or uses mentioned except as defined in the accompanying claims.

What is claimed is:

1. An electrostatically pumped heat pipe, comprising:

a heat pipe having a condenser chamber at one end and having an evaporator chamber at the other end;

cooling means at said one end and heating means at said other end to respectively condense and evaporate a dielectric refrigerant fluid in said pipe;

an ion drag pump in the condenser chamber to receive condensed refrigerant in an inlet thereof;

a small diameter tube having one end connected to a pump outlet in the condenser chamber;

said pump being adapted to pump said refrigerant into and through said tube;

said small tube having its other end terminating adjacent said evaporator chamber to discharge refrigerant condensate therein;

individual and joined heat receiving flow paths in said evaporator chamber into which said condensate is adapted to flow and to be vaporized; and individual vapor flow paths from the heat receiving flow paths in the evaporator chamber connected to a large flow path to the condenser chamber.

2. The invention according to claim 1 in which:

said condenser chamber has solid, generally smooth wall surfaces along which the refrigerant is condensed and flows into the pump inlet.

3. The invention according to claim 1 in which:

said small tube extends between the condenser and evaporator chambers within a large diameter tube having one end connected to the condenser chamber and having the other end connected to the evaporator chamber;

an annulus in the large diameter tube extending around the small diameter tube;

said annulus forming said large flow path and providing a portion of the vapor flow paths from the heat receiving flow paths to the condenser chamber.

4. The invention according to claim 3 in which:

said large and small tubes are flexible and closed between the condenser and evaporator chambers.

5. The invention according to claim 1 in which:

said heat receiving flow paths are formed in part by wire screen, generally extending in the evaporator chamber radially outwardly of its central portion.

6. The invention according to claim 1 in which:

said heat receiving flow paths are formed in part of porous metal generally extending radially and axially in the evaporator chamber.

7. The invention according to claim 3 in which:

said heat receiving flow paths in part extend to and along an internal wall of said heat pipe forming an internal wall of the evaporator chamber.

8. The invention according to claim 7 in which:

said other end of said small tube terminates adjacent a central axially extending passage in the evaporator chamber, said passage being open to said heat receiving flow paths;

said refrigerant being adapted to flow in said last flow paths toward the internal wall of the evaporator chamber and be evaporated by heat from said heating means;

said heating means being externally of said evaporator chamber.

9. The invention according to claim 8 in which:

said heat receiving flow paths extend radially outwardly of said axially extending passage;

frame members extending radially outwardly from said axially extending passage;

said frame members being annularly spaced to have said radial flow paths therebetween; and a wire screen extending around respective frame members, along said passage, along said spaces to form said radial flow paths, and extending on outer peripheral surfaces of said frame members adjacent said internal wall of the evaporator chamber.

10. The invention according to claim 9 in which:

said internal wall has annular grooves along its internal surface to form a portion of said flow paths with said peripheral screen.

11. The invention according to claim 9 in which:

said outer peripheral surfaces of said frame members are annularly spaced to have shallow axially directed grooves inwardly of and between said peripherally extending screens.

12. A method of electrostatically pumping a dielectric refrigerant in a heat pipe, comprising:

cooling a condenser chamber at one end of a heat pipe to liquefy the refrigerant at said one end to form a condensate;

flowing said condensate into an inlet of an ion drag pump, said pump being in said one end of said pipe in said condenser chamber;

applying a sufficiently high voltage difference across a cathode and an anode of the pump to produce a sufficiently high voltage gradient at the cathode to produce ions in the refrigerant condensate that are accelerated toward the anode so as to create fluid motion and pumping action through the pump outlet;

pumping said condensate out of said condenser chamber through a condensate flow path in a small diameter closed tube in the pipe and into an evaporator chamber; said tube having one end extending from the pump outlet and having its other end extending to the evaporator chamber;

flowing said refrigerant in said evaporator chamber in individual heat receiving flow paths;

applying heat to the other end of the pipe to evaporate said refrigerant in said heat receiving flow paths into a vapor in the evaporator chamber; and flowing said vapor in individual vapor flow paths from the heat receiving flow path in said evaporator chamber at said other end to a large flow path to said condenser chamber at said one end of said pipe.

13. A method according to claim 12 in which:

said small diameter tube is connected to said evaporator chamber to be open to a central flow path in the evaporator;

said central flow path being open to said heat receiving flow paths.

14. A method according to claim 13 in which:

said heat receiving flow paths are formed in part by wire screen, generally extending in the evaporator chamber radially outwardly of its central flow path.

15. A method according to claim 12 in which:

said heat receiving flow paths are formed in part of porous metal generally extending radially and axially in the evaporator chamber.

16. A method according to claim 12 in which:

said heat receiving flow paths in part extend to and along an internal wall of said heat pipe forming an internal wall of the evaporator chamber.

17. A method according to claim 12 in which:

said condenser chamber has solid, generally smooth wall surfaces along which the refrigerant is condensed and flows into the pump inlet.

18. A method according to claim 12 in which:

said condenser chamber has solid, generally smooth wall surfaces along which the refrigerant is condensed and flows into the pump inlet;

said small tube extends between the condenser and evaporator chambers within a large diameter tube having one end connected to the condenser chamber and having the other end connected to the evaporator chamber;

an annulus in the large diameter tube extending around the small diameter tube;

said annulus forming said large flow path and providing a portion of the vapor flow paths from the heat receiving flow paths to the condenser chamber.

19. A method according to claim 18 in which:

said large and small tubes are flexible and closed between the condenser and evaporator chambers.

20. A method according to claim 12 in which:

said other end of said small tube terminates adjacent a central axially extending passage in the evaporator chamber, said passage being open to said heat receiving flow paths;

said refrigerant being adapted to flow in said last flow paths toward the internal wall of the evaporator chamber and be evaporated by heat from said heating means;

said heating means being externally of said evaporator chamber.

21. A method according to claim 20 in which:

said heat receiving flow paths extend radially outwardly of said axially extending passage;

frame members extending radially outwardly from said axially extending passage;

said frame members being annularly spaced to have said radially extending flow paths therebetween; and a wire screen extending around respective frame members, along said passage, along said spaces to form said radially extending flow paths, and extending on outer peripheral surfaces of said frame members adjacent said internal wall of the evaporator chamber.

22. A method according to claim 21 in which:

said internal wall has annular grooves along its surfaces to form a portion of said flow paths with said peripheral screen.

23. A method according to claim 21 in which:

said outer peripheral surfaces of said frame members are annularly spaced to have shallow axially directed grooves inwardly of and between said peripherally extending screens.

* * * * *